US005218951A

United States Patent [19]

Chak

[11] Patent Number: 5,218,951

[45] Date of Patent: Jun. 15, 1993

[54] DEVICE FOR MONITORING OPERATION OF KITCHEN RANGE

[76] Inventor: Maryan Chak, 303 Webster Ave. #5G, Brooklyn, N.Y. 11230

[21] Appl. No.: 776,204

[22] Filed: Oct. 15, 1991

[51] Int. Cl.[5] ..... F24C 3/12

[52] U.S. Cl. ..... 126/42; 126/39 R

[58] Field of Search ..... 126/39 R, 42; 359/618, 359/350, 515, 534; 340/577, 578, 579, 628-630; 169/60, 61, 65, 23

[56] References Cited

U.S. PATENT DOCUMENTS 4,855,718 8/1989 Cholin et al. ..... 340/578
4,857,895 8/1989 Kaprelian ..... 340/630

FOREIGN PATENT DOCUMENTS 1-302032 12/1989 Japan ..... 126/39 R
826107 12/1959 United Kingdom ..... 126/27 B R

*Primary Examiner*—Larry Jones
*Attorney, Agent, or Firm*—Ilya Zborovsky

[57] ABSTRACT

A device for monitoring the operation of a kitchen range has a mirror element which can be positioned on the range so that a flame is reflected in the mirror element and can be seen by a user to adjust the flame.

8 Claims, 2 Drawing Sheets

DEVICE FOR MONITORING OPERATION OF KITCHEN RANGE

BACKGROUND OF THE INVENTION

The present invention relates to a device for monitoring the operation of a kitchen range.

The existing kitchen ranges have the disadvantage that when it is necessary to adjust the flame, this is easily possible when a small pot or pan is on the range. However, if a pot or pan has a substantial diameter, the flame cannot be easily seen and the user must bend over the see the flame under such utencil. The bending over is very inconvenient.

SUMMARY OF THE INVENTION

It is therefore an object of the present invention to provide a device which allows easy monitoring of the operation of the kitchen range, so that its flame can be easily adjusted without bending by a user.

In keeping with these objects and with others which will become apparent hereinafter , one feature of the present invention, resides, briefly stated , in a device for monitoring kitchen range operation which has a mirror element arranged to be placed near a flame of a kitchen range during its operation so that the flame is seen by a user in said mirror element and therefore the flame can be adjusted.

The device in accordance with the invention thus allows a permanent and reliable monitoring of the operation of the kitchen range without bending over, etc. in a very comfortable way.

the novel features of the present invention are set forth in the appended claims. The invention itself will be best understood from the following description of preferred embodiments which is accompanied by the following drawings.

DESCRIPTION OF PREFERRED EMBODIMENTS

Figure 1:
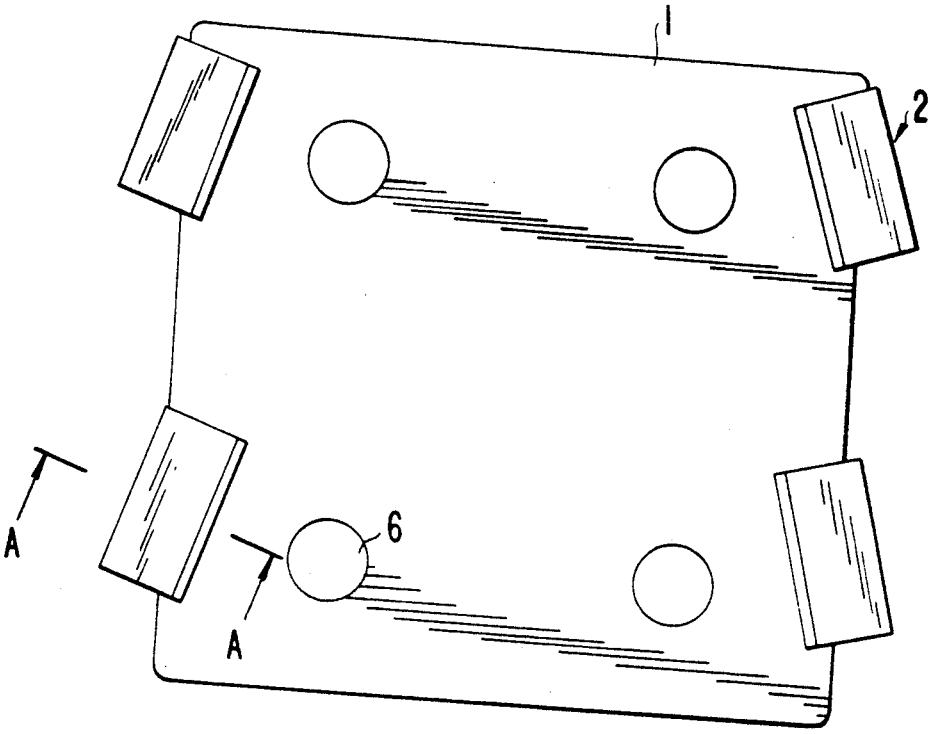
FIG. 1 is a plan view of a kitchen range with four devices for monitoring its operation in accordance with the present invention.

A device for monitoring the operation of a kitchen range 1 is identified as a whole with reference numeral 2. The device has a main body 3 and a mirror element 4 supported on the main body, for example by glueing. The main body has a supporting surface 5. In order to monitor a flame of a burner 6 of the kitchen range the device is placed with its supporting surface on the top surface of the range and moved to the area close to the respective burner 6. The flame of the burner can be seen by a user in the surface of the mirror element, and therefore adjusted. When it is no longer needed, the device is slid away from the burner.

Figure 2:
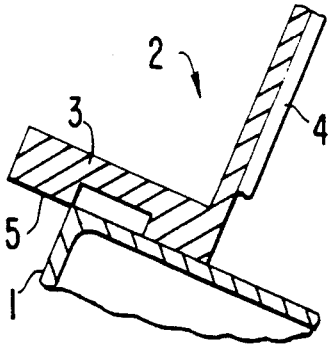
FIG. 2 is a side view of one of the devices of the invention.

In the embodiment of FIGS. 1,2 the mirror element 4 is straight or in other words it has a flat single surface.

Figure 3:
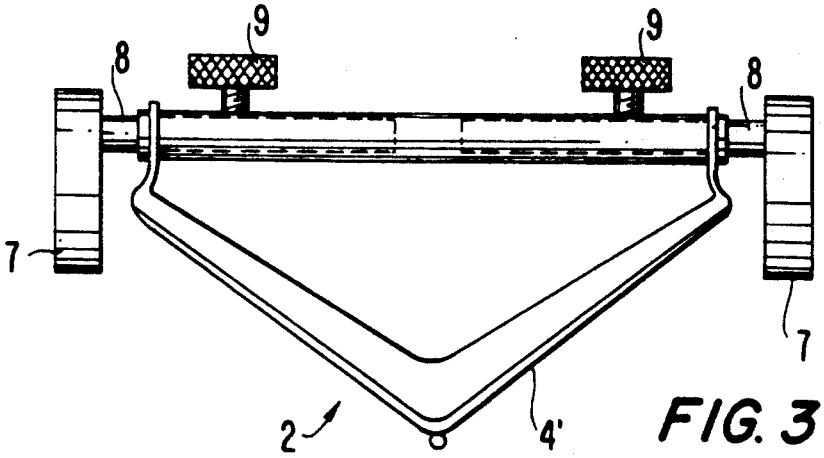
FIGS. 3 and 4 are plan views of two further modifications of the invention device.

In contrast, in the embodiment of FIG. 3 the mirror element 4' has two straight surfaces arranged at an angle relative to one another . Therefore the device 2' can be placed on the range so that simultaneously the flames of two neighboring burners can be seen , when the device is located between two burners and its surfaces face the burners. In this embodiment the height of each surface can be adjusted as well. The device has two legs 7 connected with two rods 8. Each rod 8 can be turned so as to turn the leg 7 and therefore to adjust the height, and then fixed by a fixing screw 9.

Figure 4:
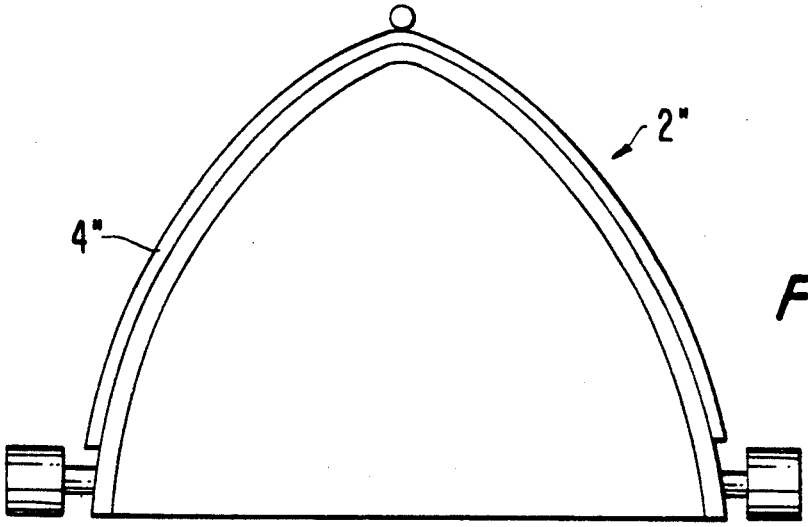
Figure 5:
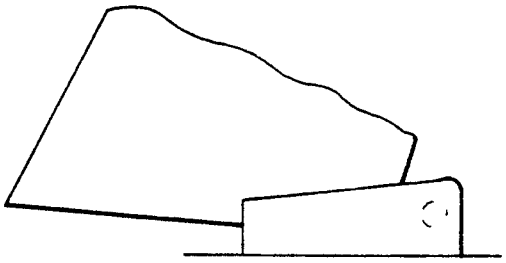
FIGS. 5 and 6 show two different positions of supporting legs of the inventive device of FIGS. 3 and 4.
Figure 6:
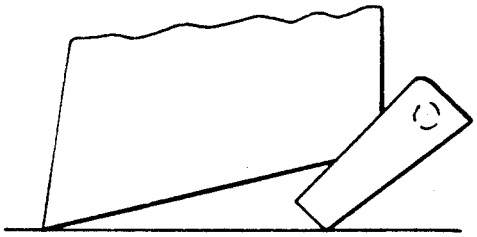

The embodiment of FIG. 4 differs from the embodiment of FIG. 3 only in that the mirror element 4'' has two curved mirror surfaces. A spherical handle 10 is used for moving the device over the surface of the range, etc.

Figure 7:
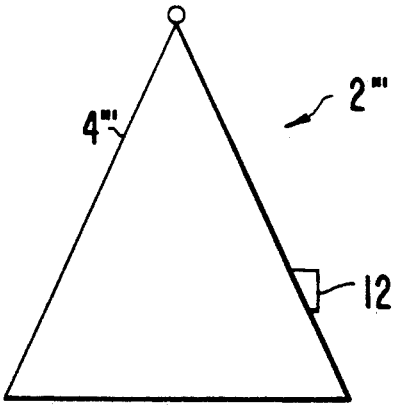
FIGS. 7 and 8 are a side view and a plan view of the device in accordance with a further embodiment of the invention.
Figure 8:
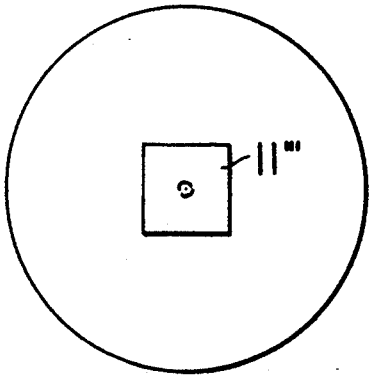

In the embodiment of FIGS. 7 and 8 the device is conical and has a conical mirror element 4'''. Its supporting surface is a lower base of the cone having a vertical axis.

Reference numeral 12 identified a smoke detector. It detects burning of a pot or pan on a burner and triggers its alarm system. Smoke detectors of this type are known. The mirror element can be of any material,for example of plastic. Reference numerals 11 and 11''' identify magnets which are located in respective cavities provided in the main body of the device. Due to the magnets, the device is held on the range and does not fall from it. On the other hand, the attractive force of the magnet is such that the device can still be moved over the range to a desired position.

The invention is not limited to the details shown since various modifications and structural changes are possible without departing in any way from the spirit of the invention.

A cap 21 is further arranged on the mirror element to shield undesired outside light which can otherwise impinge on the mirror element and distort or overlap the reflection of the burner flame in the mirror element. A light filter 22 performs actually a similar function of screening the undesired outside light, for example sunlight and thereby preventing distorting of overlapping of the burner flame reflection. are known. The mirror element can be of any material, for example of plastic metal. Reference numerals 11 and 11'''' identify a cavity in the main body of the device to reduce its weight.

The invention is not limited to the details shown since various modifications are possible without departing from the spirit of the invention.

What is desired to be protected by Letters Patent is set in the claims.

I claim:

1. A device for monitoring kitchen range operation, comprising a mirror element arranged to be placed near a flame of a kitchen range during its operation and means to temporarily attach the mirror to the range and adjust the position of the mirror so that during its operation the flame is seen by the user in said mirror element and therefore the flame can be adjusted; and a smoke detector connected with said mirror element and arranged to detect smoke of a pot or pan on the range.

2. A device as defined in claim 1, wherein said mirror element has two reflecting surfaces arranged so that two flames can be seen by a user in said mirror element.

3. A device as defined in claim 2, wherein said non-straight face of said mirror element is curved and forms said two reflecting surfaces.

4. A device as defined in claim 1, wherein said non-straight face of said mirror element is conical and has an axis adapted to extend in a vertical direction when the device stands on the range.

5. A device as defined in claim 1; and further comprising a grasping element adapted to be grasped by a user to move the device, said grasping element being ball-shaped.

6. A device as defined in claim 1; and further comprising a cap arranged on said mirror element to protect said mirror element for undesired outside light.

7. A device as defined in claim 1; and further comprising a filter arranged on said mirror element to supress reflection of undesired outside light.

8. A device for monitoring kitchen range operation, comprising a mirror element arranged to be placed near a flame of a kitchen range during its operation so that during its operation the fame is seen by a user in said mirror element and therefore the flame can be adjusted; means for adjusting a height of said mirror element when it stands on the range and including two supporting members arranged to support said mirror element at two spaced locations and two adjusting members operative for adjusting said supporting members independently of one another so that said mirror element can assume an inclined position; and a smoke detector connected with said mirror element and arranged to detect smoke of a pot or pan on the range.

* * * * *